US005653307A

United States Patent [19]

Kerr

[11] Patent Number: 5,653,307

[45] Date of Patent: Aug. 5, 1997

[54] DUAL TRACK MOUNTED PIVOTING LADDER ASSEMBLY

[75] Inventor: James F. Kerr, Croswell, Mich.

[73] Assignee: Material Control, Inc., Croswell, Mich.

[21] Appl. No.: 534,016

[22] Filed: Sep. 26, 1995

Related U.S. Application Data

[63] Continuation-in-part of Ser. No. 354,603, Dec. 13, 1994, Pat. No. 5,480,002, which is a continuation-in-part of Ser. No. 298,531, Aug. 29, 1994, Pat. No. 5,413,191, which is a continuation of Ser. No. 204,105, Mar. 1, 1994, abandoned, which is a continuation of Ser. No. 63,409, May 18, 1993, abandoned.

[51] Int. Cl.[6] ..... E06C 7/00

[52] U.S. Cl. ..... 182/38; 182/15; 182/39

[58] Field of Search ..... 182/38, 39, 84, 182/97, 86, 15

[56] References Cited

U.S. PATENT DOCUMENTS

| | | | |
|---|---|---|---|
| 356,375 | 1/1887 | Perkins . | |
| 470,374 | 8/1892 | Fisher | 182/39 |
| 528,824 | 11/1894 | Sumner . | |
| 553,108 | 1/1896 | Davison | 182/38 |
| 862,622 | 8/1907 | Eller | 182/38 |
| 907,401 | 12/1908 | Prouty . | |
| 938,016 | 10/1909 | Niblack | 182/39 X |
| 1,118,385 | 11/1914 | Timmerman | 182/38 |
| 1,320,740 | 11/1919 | Coghlin . | |
| 1,341,996 | 6/1920 | Plucienski . | |
| 3,735,838 | 5/1973 | Greenleaf | 182/39 |
| 5,148,889 | 9/1992 | Fenwick et al. . | |

FOREIGN PATENT DOCUMENTS

| | | | |
|---|---|---|---|
| 691905 | 8/1930 | France | 182/39 |
| 832727 | 10/1938 | France . | |
| 271149 | 1/1930 | Italy | 182/39 |

OTHER PUBLICATIONS

Storage Wall System (Lista), Catalog Sw–255 Sep. 26, 1995.

Rolling Wood Ladders (Cotterman), Bulletin WL–188, Jul. 1, 1995.

*Primary Examiner*—Alvin C. Chin-Shue

*Attorney, Agent, or Firm*—Dykema Gossett PLLC

[57] ABSTRACT

The ladder system is located adjacent the front face of a storage rack. The ladder is carried by a cantilever supported carriage assembly having a pair of pivotally mounted frames. The ladder is connected to one frame and may move longitudinally along the front face of the storage rack. The ladder and its frame may also be moved laterally in an arc up to 90° in a direction extending perpendicular to the front face of the storage rack. The carriage assembly includes a horizontal ladder support arm on the first frame upon which the ladder is mounted. A user can quickly and easily position the ladder at any position along the storage rack for accessing items stored on the shelves. This ladder system is particularly useful in crowded warehouse-type retail outlets which are now in popular use across the country.

10 Claims, 3 Drawing Sheets

DUAL TRACK MOUNTED PIVOTING LADDER ASSEMBLY

This application is a continuation-in-part application of patent application Ser. No. 08/354,603, filed Dec. 13, 1994, entitled "DUAL TRACK NOUNTED LADDER SYSTEM", now U.S. Pat. No. 5,480,002, issued Jan. 2, 1996, which is a continuation-in-part of patent application Ser. No. 08/298,531, filed Aug. 29, 1994, now U.S. Pat. No. 5,413,191, issued May 9, 1995, which is a continuation of patent application Ser. No. 08/204,105, filed Mar. 1, 1994, now abandoned, and which in turn is a continuation of patent application Ser. No. 08/063,409, filed May 18, 1993, now abandoned.

BACKGROUND OF THE INVENTION

1. Field of the Invention

The ladder system is designed to be used in large retail stores and warehouses where storage shelves are located one on top of the other along the walls and the aisles where products and merchandise are stored. The storage room shelves may be anywhere from ten to twenty feet in height, sometimes even higher. When employees or workers remove large, sometime bulky packages from the shelves unassisted using only a ladder, such employees can fall thereby injuring themselves. This results in not only lost time for the employees but also the company may be responsible for the workers' injuries.

2. Description of the Prior Art

One way of obtaining a package off from an overhead shelf is shown in U.S. Pat. No. 2,894,641, where a worker must carry a heavy platform to the desired site, then use a separate ladder to get to the platform. Thus, the employee has to incur the risk of having the ladder, platform or both slip while climbing, and once on the platform, the employee still has to climb down the ladder carrying the heavy package. Another prior art ladder is mounted on rollers for movement along the aisle while this type of ladder has benefits in some applications, if there are obstructive items stored on the floor of the aisle, the ladder may not always be able to pass around the obstructive items. The "library-type" ladder is also known in the prior art and is mounted for movement longitudinally along the storage racks or shelves. If obstructive items are in the way of the ladder, the ladder may not be able to move around the obstructive items.

SUMMARY OF THE INVENTION

It is a feature of the present invention to provide a ladder system for a storage rack or racking. The system incorporates the concept of two tracks, one track being provided at the top of the storage rack and the other track at a lower level on the same storage rack. The ladder is designed to be mounted on the upper and lower tracks and movable parallel to the front face of the racking.

A further feature of the present invention is to provide a ladder system having a movable carriage assembly which supports the ladder and is carried by the upper and lower tracks. The upper track carries most of the load placed on the ladder while the lower track provides stability and rigidity for the ladder system.

A still further feature of the present invention is to provide a ladder system of the aforementioned type having a movable carriage system with a first movable frame having a horizontal arm extending parallel to the upper track and a generally vertical strut connected to and depending from the horizontal arm. The carriage assembly also includes a second movable frame to which the ladder is connected. The second frame is pivotally carried by the first frame to permit the second movable frame and ladder to swing through an angle of up to 90° and to position the ladder relative to the front face of a storage rack, as an example, at 90°.

Another feature of the present invention is to provide a ladder system having a ladder similar to a conventional staircase including hand rails at opposite sides, with the lower end of the ladder being provided with casters and a safe-lock assembly for holding the casters of the ladder in a fixed position on the support surface.

Still another feature of the present invention is to provide a ladder system of the aforementioned type wherein the upper end of the ladder is pivotally mounted on the horizontal ladder support arm of the second movable frame thereby permitting the ladder to pivot and be lifted over obstructions in the aisle or projecting from the storage rack.

Still another feature of the present invention is to provide dual track mounted pivoting ladder assembly which permits the ladder to swing outwardly at right angles to the storage rack in addition to rolling parallel to the rack.

A further feature of the present invention is to provide a safe, cost effective way of obtaining packages from overhead areas without causing injury to the workers or employees.

A still further feature of the present invention is to provide a ladder system wherein an elevated platform is connected to the upper end of the ladder at a location which permits the user to have access to the space of the storage rack between the upper and lower tracks.

Another feature of the present invention is to provide a ladder system of the aforementioned type wherein the ladder is carried by the upper and lower tracks at an angle to the support surface of between 50 and 65 degrees.

DETAILED DESCRIPTION OF THE PREFERRED EMBODIMENT

Figure 1:
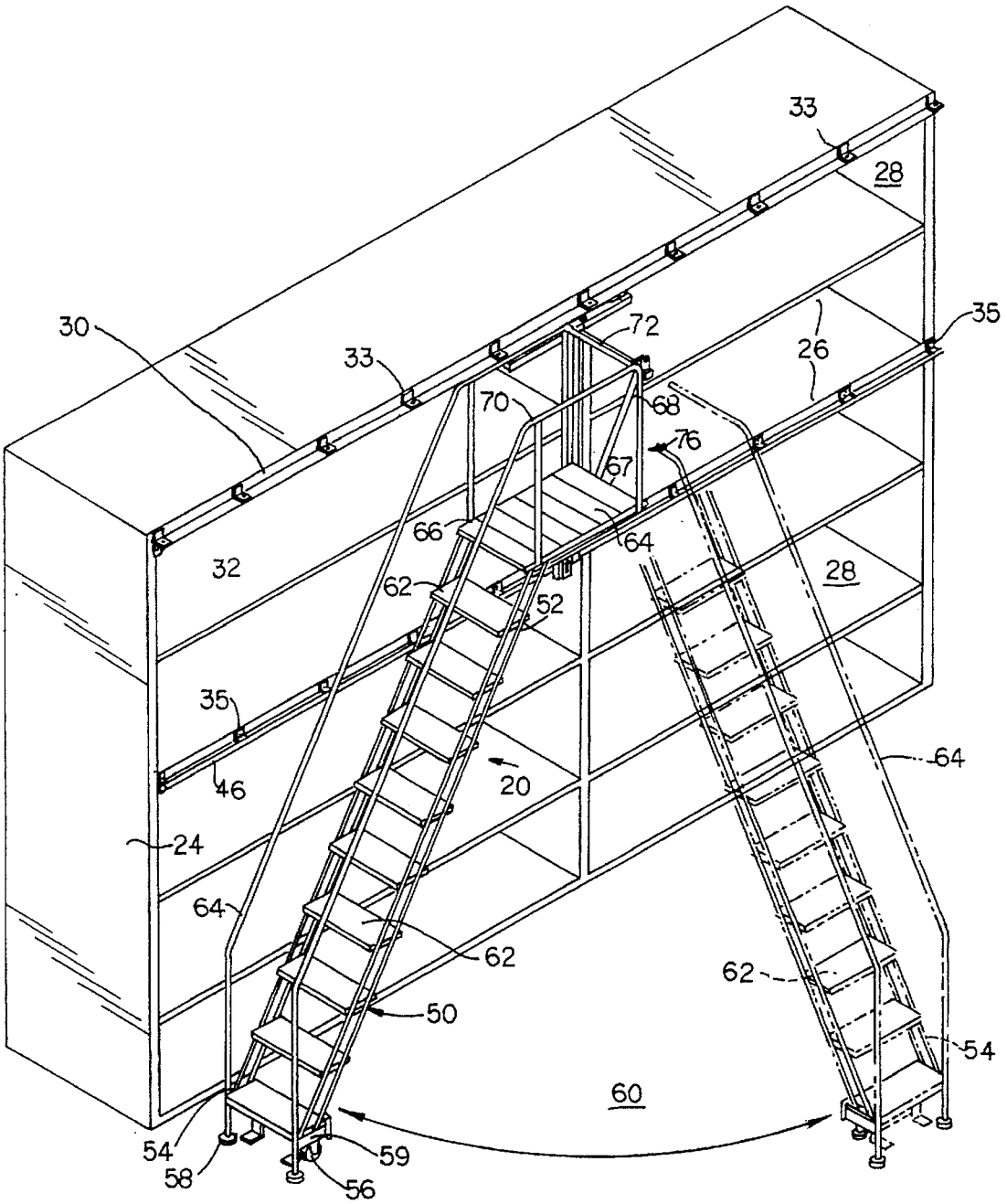
FIG. 1 is a perspective view of the ladder system mounted on the front face of a storage rack and showing the ladder in two different positions which are 90° apart.
Figures 2, 3, 4:
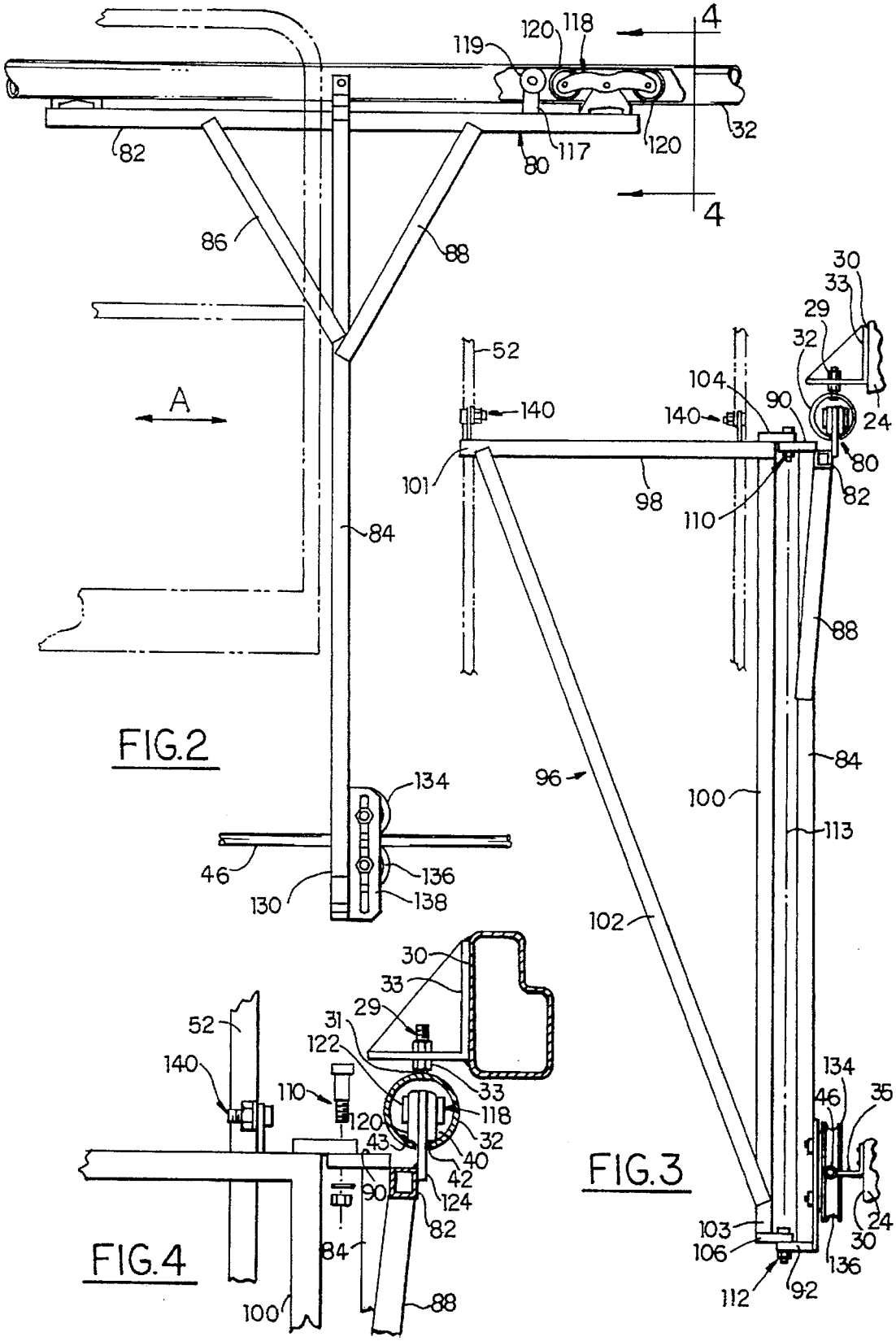
FIG. 2 is a fragmentary elevational view of the ladder system showing the movable carriage assembly mounted on the upper and lower tracks.
FIG. 3 is a fragmentary end view of the ladder system of FIG. 2 and illustrating the manner in which the upper end of the ladder is pivotally mounted on the horizontal ladder support arm of the cantilever mounted carriage assembly which is in turn carried by the upper and lower tracks.
FIG. 4 is a fragmentary end view of the carriage assembly taken on the line 4—4 of FIG. 2.

FIG. 1 illustrates a ladder system 20 mounted on a shelving unit 24 at one side of an aisle of large commercial retail stores and outlets. The ladder system 20 of the present invention is designed to be mounted on shelving units having a height between ten feet and twenty feet or higher as is now common in retail outlets and warehouses. The shelving or shelving unit 24 may contain any number of shelves 26 where packages, goods and other items may be stored. The ladder system 20 is designed to permit a person or user of the system to have access to the packages or goods stored within the storage spaces 28 provided between the shelves 26. The shelving unit 24 has a front face 30 lying in a vertical plane. Adjacent the front face 30 is an upper tubular track 32 of generally circular cross-section. Spaced vertically below the upper track 32 is a lower tubular track 46 of circular outer cross-section throughout its length. The lower track 46 is spaced vertically from the upper track 32. The upper track 32 is appropriately connected to the shelving 24 by means of a plurality of upper hangers 33 which are spaced longitudinally apart along the length of track 32. The lower track 46 is connected to the front face 30 of the shelving 24 by means of a row of longitudinally spaced lower straps 35. The straps 33 and 35 each have a vertical flange which is appropriate secured by bolting or welding to the shelving 24. Each strap 33, 35 further includes a horizontal flange which is appropriately connected by threaded fasteners 29 to the upper track 32 as best illustrated in FIGS. 3 and 4. The fasteners 29 include threaded bolts 31 and nuts 33. The bolts 31 are welded to the track 32 along the length thereof, with a pair of adjustable nuts 33 secured to opposing sides of the horizontal flange of each strap 33.

The upper track 32 is of generally tubular configuration (FIG. 4) and is provided with a longitudinal slot 42 which extends from one end of the track 32 to the other end. The interior bottom wall or surface 40 of the tubular track 32 is divided into a pair of bearing surfaces 43 located on opposite sides of the longitudinal slot 42. Rollers move inside of the track 32 as will be subsequently described.

The lower track 46 is connected by the plurality of straps 35 to the shelving 24. It should be understood that the upper and lower tracks 32, 46 may be mounted in various ways to the shelving 24. When mounting the upper and lower tracks 32, 46, it is important that the vertical centerline of each track coincide. Thus, the centerline of the tracks usually lie in a vertical plane which is generally parallel to the front face 30 of the shelving 24.

The ladder system 20 further includes a ladder 50 having an upper end 52 and a lower end 54. The ladder 50 is provided with suitable casters or wheels 56 and a pair of rubber bumpers 58 for supporting the lower end of the ladder on the support surface 60 as shown in FIG. 1. A safe-lock assembly 59 is provided adjacent the casters 56 to lock the casters or wheels 56 when the ladder 50 is being used. The ladder 50 is provided with a series of vertically spaced steps 62. Suitable hand rails 64 are provided on opposite sides of the ladder 50 and extend from the lower end 54, as best shown in FIG. 1, to the upper end 52. The ladder 50 is mounted at an angle of from 50° to 65° (FIG. 1) thereby providing an easy climbing angle as in a standard stairway.

A platform 64 is provided at the upper end 52 of the ladder 50. The platform 64 is appropriately connected to opposite sides of the ladder 50 at 66, with the front edge 67 of the platform 64 being connected by a pair of vertical struts 68 to the hand rail extension 70 and 72 as illustrated in FIG. 1.

The ladder system 20 further includes a cantilevered mounted carriage assembly 76 to which the ladder 50 is connected. The cantilever mounted carriage assembly 76 includes a first moveable frame 80 having a first horizontal arm 82 (FIG. 2) extending parallel to the upper track 32 and a generally vertical strut 84. Strut 84 is connected to the horizontal arm 82 by means of a pair of braces 86 and 88. The horizontal arm 82 is offset slightly from the plane of the tubular or vertical strut 84 as best illustrated in FIG. 3. The braces 86 and 88 are appropriately connected at the end thereof by welding or other suitable means to the horizontal arm 82 and to the vertical strut 84. The upper end of the vertical strut 84 is provided with a flat pivot plate 90 while the lower end of the vertical strut 84 is provided with a flat pivot plate 92. The plates 90 and 92 are secured to the strut 84 by welding or other fastening means.

The cantilevered carriage assembly 76 further includes a second moveable frame 96 including a horizontal ladder support arm 98, which is perpendicular to the horizontal arm 82, and a vertical arm 100 which extends generally parallel to and is spaced from the vertical strut 84. A diagonal brace 102 connects the outer end 101 of the horizontal ladder support arm 98 to the lower end portion 103 of the vertical arm 100 as best shown in FIG. 3.

The upper end of the vertical arm 100 is provided with a pivot element 104 which overlies the pivot plate 90 provided on the vertical strut 84. The lower end of the vertical arm 100 is provided with a pivot plate 106 which overlies the plate 92 provided at the lower end of the vertical strut 84.

Upper pivot or pivot means 110 is provided between the bearing plates 90 and 104 while lower pivot or pivot means 112 is interposed between the bearing or pivot plates 106 as best shown in FIG. 3. The upper pivot 110 and the lower pivot 112 each have an axis which lie in the same vertical plane. The axis common to both pivots 110 and 112 lies in a plane 113 which is parallel to the plane containing the vertical arm 100 as well as the vertical strut 84. The second moveable frame 96 is adapted to swing in an arc of up to 90° about the pivots 110 and 112, like a door which pivots about the hinges mounting the door in a door frame.

The cantilever mounted carriage assembly 76 is carried by the upper track 32 and the lower track 46. Specifically, the opposing ends of the horizontal arm 82 are each provided with a cannonball skate wheel truck 118 having a pair of rollers or bearings 120. In addition, a mounting bracket 117 carrying a skate wheel 119 is also carried by the horizontal arm 82. The skate wheels 119 are located inboard or in between the cannonball skate wheel trucks 118. Each truck 118 is carried by a roller bracket or strap 124 affixed to the arm 82. The rollers 120 are journaled to the bracket 124 by an axle or pin 122. The roller bearings and skate wheel assembly or truck moves on the bearing surfaces 43 defined by the bottom wall 40 when the ladder 50 is moved in a longitudinal direction A (FIG. 2) which is defined as extending parallel to the front face 30 of the storage rack or shelving 24. The brackets 124 move through the slot 42 as the rollers 120 traverse the bearing surfaces 43.

The lower end 130 of the vertical strut or arm 84 of the first frame 80 of the cantilever mounted carriage assembly 76 is provided with a pair of vertically spaced rollers 134 and 136. The rollers 134, 136 are adjustably mounted on a bracket 138 secured to strut 84 as shown in FIG. 2. The lower track 46 is of arcuate, circular, or curved cross-section corresponding to the curvature of the rollers 134 and 136 as best shown in FIGS. 2 and 3.

When the ladder 50 is moved in the longitudinal direction A, which extends parallel to the front face of the storage rack 24, the upper rollers 120 move along the bearing surfaces 43 defined by the bottom wall 40 of the upper track 32. The upper rollers or bearings 120 at opposite ends of the horizontal arm 82 support most of the load placed upon the ladder system 20. The vertically spaced rollers 134 and 136 carried by the vertical strut 84 are generally not load bearing rollers and are provided to provide stability and rigidity for the cantilever mounted carriage assembly 76 and for the ladder 50.

Figure 5:
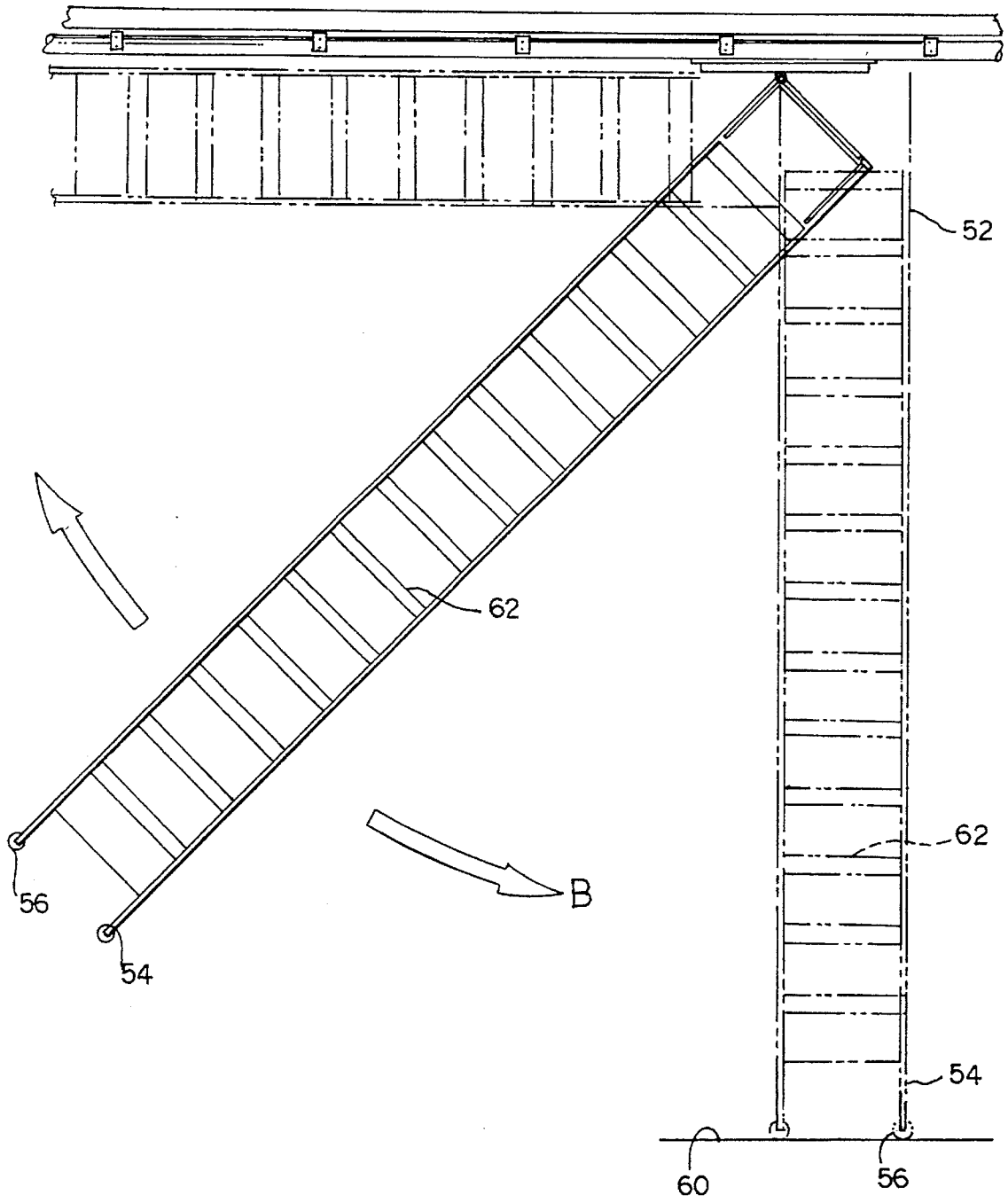
FIG. 5 is a top view of the ladder system illustrating the manner of swinging the ladder between several operative positions which are 90° apart.

The present invention further includes a feature which permits the ladder 50 to pivot or to swing outwardly in a lateral direction B (FIG. 5) at an angle to the storage rack 42 in addition to rolling parallel to the racking or storage rack 24 as previously described. The top 52 of the ladder 50 is provided with a pair of transversely spaced pivots 140 on opposite sides of the ladder as shown in FIG. 3. Each pivot connects one side of the ladder 50 to the horizontal ladder support arm 98. With such a construction, a person may take hold of the ladder 50 and rotate the ladder 50 about the pivots 140 to permit the ladder 50 to be raised above obstructions in the aisle or to avoid obstructions projecting from the storage rack 24.

A particular ladder has been illustrated in the drawings. It should be understood that other types of ladders may incorporate the inventive features. As an example, a ladder could be employed which does not have a platform 64 but yet the ladder is mounted on the carriage assembly 76 for movement in a longitudinal direction A as well as in a lateral direction B which extends perpendicular to the front face of the storage rack. Moreover, the ladder may be metal, wood or another appropriate material.

A preferred embodiment of the present invention has been disclosed. However, a worker of ordinary skill in the art would recognize that certain modifications would come within the scope of this invention. For that reason, the following claims should be studied in order to determine the scope and content of this invention.

What I claim is:

1. A ladder system for positioning a ladder relative to a storage rack having a front face and located at one side of an aisle, a longitudinal direction being defined as extending parallel to the front face of the storage rack and a lateral direction being defined as extending at an angle to the front face of the storage rack, the ladder system comprising:

a ladder having upper and lower ends, with the lower end being engageable with a horizontal support surface;

an upper track located near the front face of the storage rack;

a lower track extending parallel to and being vertically spaced below said upper track and located near the front face of the storage rack;

a movable carriage assembly including a first moveable frame having a horizontal arm having first and second ends, said horizontal arm extending paralled to and being located slightly below said upper track;

a pair of longitudinally spaced upper roller assemblies engageable with said upper track;

brackets fixedly connecting said roller assemblies to the first and second ends of said horizontal arm;

said first moveable frame also having a generally vertical strut with an upper end portion and a lower end portion, said upper end portion being connected to said horizontal arm generally midway between said first and second ends;

the lower end portion of said vertical strut being provided with a pair of lower rollers which are engageable with opposing portions of said lower track;

said moveable carriage assembly including a second movable frame including a horizontal ladder support arm having first and second ends and a vertical arm having an upper end portion;

said first end of said horizontal ladder support arm being connected to and perpendicular to said upper end portion of said vertical arm;

an upper pivot means interposed between said upper end portion of said vertical strut and said first end of said horizontal ladder support arm;

a lower pivot means interposed between the lower end portion of said vertical strut and the lower end of said vertical arm;

said upper and lower pivot means each having an axis lying in a vertical plane which is parallel to and is located between said vertical strut and said vertical arm;

means for mounting the upper end of said ladder on said horizontal ladder support arm;

said upper and lower pivot means between said first and second moveable frames permitting said second moveable frame and said ladder to swing in a lateral direction relative to said first moveable frame and to thereby reposition said ladder relative to the front face of the storage rack; and said upper roller assemblies and said pair of lower rollers being moveable along said upper and lower tracks respectively as said carriage assembly and said ladder are moved in the longitudinal direction paralled to the front face of the storage rack.

2. The ladder system as recited in claim 1, wherein said upper roller assemblies are engageable with said upper track and support most of the load placed upon said ladder system, said lower rollers attached to said vertical strut being generally non-load bearing rollers providing stability and rigidity for the ladder system.

3. The ladder system as recited in claim 1, wherein the upper end of said ladder is pivotally mounted on said horizontal ladder support arm to permit the ladder to be moved around obstructions in the aisle or projecting from the storage rack.

4. The ladder system as recited in claim 1, wherein said ladder at the upper end thereof is provided with an elevated platform for supporting a user as the user stores or removes an article from the storage rack.

5. The ladder system as recited in claim 4, wherein said elevated platform is carried by said ladder at a location which permits the user to have access to the space between said upper and lower tracks.

6. The ladder system as recited in claim 1, wherein the lower end of said ladder is provided with wheels engageable with the support surface and a safety lock assembly for locking the wheels in place on the support surface when the ladder system is in use.

7. The ladder system as recited in claim 1, wherein the lower end of said ladder is provided with a pair of rubber bumpers for engaging the horizontal support surface.

8. The ladder system as recited in claim 1, wherein said ladder is carried by said upper and lower tracks at an angle between 50 and 65 degrees.

9. The ladder system as recited in claim 1, wherein said ladder includes a pair of hand rails at opposite sides of the ladder, said hand rails extending from the lower end to the upper end of the ladder.

10. The ladder system as recited in claim 1, wherein said second moveable frame and said ladder swing about said upper and lower pivot means at an angle up to 90°.

* * * * *